US009590326B2

(12) United States Patent
Yang et al.

(10) Patent No.: US 9,590,326 B2
(45) Date of Patent: Mar. 7, 2017

(54) CONTACT TERMINAL FOR PRINTED CIRCUIT BOARD

(71) Applicant: Samsung Electronics Co., Ltd., Gyeonggi-do (KR)

(72) Inventors: Soon-Woong Yang, Gyeonggi-do (KR); Young-Gyun Kim, Gyeonggi-do (KR)

(73) Assignee: Samsung Electronics Co., Ltd., Yeongton-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/309,365

(22) Filed: Jun. 19, 2014

(65) Prior Publication Data

US 2014/0302730 A1 Oct. 9, 2014

(30) Foreign Application Priority Data

Sep. 6, 2011 (KR) ..... 10-2011-0090077

(51) Int. Cl.

| | |
|---|---|
| ***H01R 12/00*** | (2006.01) |
| ***H01R 12/55*** | (2011.01) |
| ***H01R 12/58*** | (2011.01) |
| ***H01R 13/24*** | (2006.01) |

(52) U.S. Cl.

CPC ..... *H01R 12/55* (2013.01); *H01R 12/58* (2013.01); *H01R 13/2442* (2013.01)

(58) Field of Classification Search

CPC .... H01R 12/57; H01R 13/2435; H01R 9/096; H01R 12/52; H01R 12/526

USPC ..... 439/862, 66, 81

See application file for complete search history.

(56) References Cited

U.S. PATENT DOCUMENTS

| | | | | |
|---|---|---|---|---|
| 4,239,312 | A | 12/1980 | Myer et al. | |
| 5,139,427 | A | 8/1992 | Boyd et al. | |
| 5,152,695 | A | 10/1992 | Grabbe et al. | |
| 5,632,631 | A * | 5/1997 | Fjelstad | G01R 1/0466 257/E23.067 |
| 6,652,314 | B2 | 11/2003 | Tournadre | |
| 7,189,077 | B1 | 3/2007 | Eldridge et al. | |
| 7,220,152 | B2 * | 5/2007 | Jeong | H01R 13/2492 439/862 |
| 7,267,557 | B2 * | 9/2007 | Chen | G01R 1/06727 439/81 |
| 7,972,186 | B2 * | 7/2011 | Tsao | H01R 12/585 439/876 |

* cited by examiner

*Primary Examiner* — Phuong Dinh

(74) *Attorney, Agent, or Firm* — Cha & Reiter, LLC

(57) ABSTRACT

A contact terminal device for a Printed Circuit Board (PCB), includes the contact terminal being formed to correspondingly cover at least a portion of an opening formed in the PCB and a terminal member fixed onto the PCB, in which the terminal member includes a fixing portion fixed around the opening on a surface of the PCB and a contact terminal portion extending from the fixing portion to be disposed on the opening. The contact terminal for the PCB reduces a height from a surface of the PCB to a contact point with a counterpart component, i.e., a contact height, contributing to reducing the thickness of the portable terminal.

20 Claims, 5 Drawing Sheets

CONTACT TERMINAL FOR PRINTED CIRCUIT BOARD

CROSS REFERENCE TO RELATED APPLICATIONS

The present application is a Continuation of U.S. patent application Ser. No. 13/404,729 filed on Feb. 24, 2012 which claims the benefit of priority under 35 U.S.C. §119(a) from a Korean Patent Application filed in the Korean Intellectual Property Office on Sep. 6, 2011 and assigned Serial No. 10-2011-0090077, the entire disclosure of which is hereby incorporated by reference in its entirety.

BACKGROUND

Field of the Invention

The presently claimed invention generally relates to a Printed Circuit Board (PCB) used for various electronic devices. More particularly, the presently claimed invention relates to a contact terminal provided on a PCB to contact various additional devices to the PCB.

Description of the Related Art

Generally, a contact terminal is a connection structure used for connection between devices or circuit devices, and is utilized in devices having various electronic circuits embedded therein. An example of such a structure being an interior wiring terminal box in a building, an electronic product like a vacuum cleaner, etc., a table clock, a portable media player, a battery connection structure of a wireless mouse, etc., a built-in antenna or a battery connection structure of a portable terminal, and so forth. The contact terminal is typically made using a leaf spring because the leaf spring can provide sufficient contact area and self elasticity for maintaining close contact with a counterpart component, such as a battery pack, etc., which is a contact target.

The contact terminal is bent into a 'U' shape, a first free end of the contact terminal is fixed to an inner side of an electronic device, such as a Printed Circuit Board (PCB). A second free end of the contact terminal is disposed to be spaced apart from the PCB. The first free end and the second free end of the contact terminal are connected to each other through a curved portion, such that the contact terminal has the 'U' shape. In a portable terminal, a counterpart component, such as a battery pack or an antenna device, is connected through the contact terminal, and in this case, the second free end contacts with the counterpart component.

FIGS. 1 and 2 show a terminal member 10 of a contact terminal and a structure in which the contact terminal is installed on a portable terminal 20 according to an embodiment of a conventional art.

Referring now to FIG. 1, the terminal member 10 is made by bending a leaf spring, in which a first free end 11 and a second free end 13 are positioned to face each other and are connected through a curved portion 19 in the form of a curved surface, thus forming an alphabetic 'U' shape. At an end portion of the second free end 13 is provided a contact surface 15 in the form of a curved surface a portion of which extends away from the first free end 11 and is bent toward the first free end 11. A part of the first free end 11 is bent in a similar manner as the contact surface 15 close to the contact surface 15 to prevent the second free end 13 from too far from the first free end 11.

FIG. 2 shows a cross-section of the portable terminal 20 in which a carrier 27 forming a built-in antenna device is installed inside an edge of a side of a housing 21. The carrier 27 may have an antenna pattern formed on an outer circumferential surface thereof and a speaker phone or a microphone embedded therein. On a back surface of the housing 21, a battery pack is removably provided and a separate cover member 23 for hiding and protecting the battery pack is also provided.

The terminal member 10 is positioned onto a PCB 25 disposed in the housing 21 to form the contact terminal. A part of the carrier 27 is positioned to face a part of the PCB 25, and the terminal member 10 is interposed between the carrier 27 and the PCB 25. The first free end 11 is fixed onto a surface of the PCB 25, and the second free end 13 is positioned to face a part of the carrier 27, such that the contact surface 15 contacts the carrier 27. A feeding line of an antenna pattern formed in the carrier 27 contacts the contact surface 15, thus being connected to a communication circuit provided on the PCB 25.

However, such a conventional contact terminal is difficult to apply to a portable terminal, especially since new versions of portable terminals continue become thinner than previous versions. In other words, in a built-in antenna connection structure, a part of a PCB and a part of a carrier face each other and a terminal member is disposed between the PCB and the carrier. Due to the height of the conventional terminal member, reduction of the thickness of the portable terminal is limited. The thickness may be gradually reduced toward the edge of the portable terminal, making a user feel that the portable terminal appears thinner than in actuality. However, in the terminal of this type shown in FIG. 2, it is difficult to secure a mounting space for a built-in antenna due to the structure of the contact terminal. The space for installing the contact terminal may be secured by cutting a part of the carrier, but in this case, an area for forming the antenna pattern is reduced.

SUMMARY

Accordingly, an exemplary aspect of the present invention is to provide a contact terminal for a PCB, which sufficiently secures an area for forming an antenna pattern while contributing to a reduction in a thickness of a portable terminal.

A contact terminal device for a Printed Circuit Board (PCB), includes the contact terminal being formed to correspondingly cover at least a portion of an opening formed in a PCB.

According to an exemplary aspect of the present invention, there is provided a contact terminal for a Printed Circuit Board (PCB), the contact terminal including an opening formed in the PCB and a terminal member fixed onto the PCB, in which the terminal member includes a fixing portion fixed around the opening on a surface of the PCB and a contact terminal portion extending from the fixing portion to be disposed on the opening.

According to an exemplary aspect of the present invention, an electrical contact terminal for mounting on a platform, in which the electrical contact terminal comprises: a terminal member adapted to be affixed onto the platform, and wherein the terminal member comprises: a fixing portion fixed adapted for mounting around an opening on a surface of the platform; and a contact terminal portion extending from the fixing portion to be disposed on or over the opening on the surface of the platform; wherein the terminal member comprises a substantially flat singular structure.

BRIEF DESCRIPTION OF THE DRAWINGS

The above and other exemplary features and advantages of exemplary embodiments of the present invention will become more apparent to a person of ordinary skill in the art from the following detailed description taken in conjunction with the accompanying drawings, in which.

DETAILED DESCRIPTION

Hereinafter, exemplary embodiments of the present invention will be described in detail with reference to the accompanying drawings. The detailed descriptions of functions and configurations incorporated herein that are well-known to those skilled in the art may be omitted when their inclusion could unnecessarily obscure appreciation of the present invention by a person of ordinary skill in the art with such well-known functions and configurations.

Figure 3:
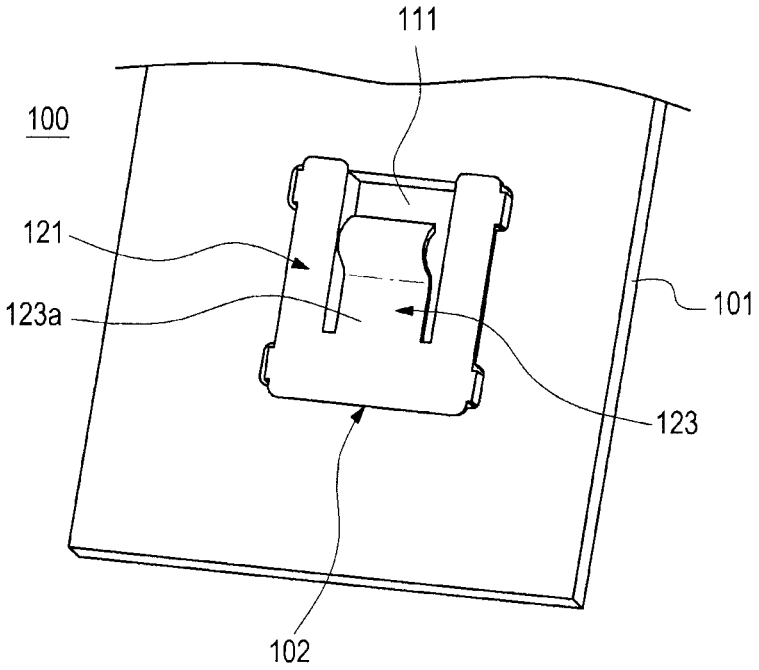
FIG. 3 is a perspective view of a contact terminal for a PCB according to an exemplary embodiment of the present invention.

FIG. 3 is a perspective view of a contact terminal 100 for a Printed Circuit Board (PCB) 101 according to an exemplary embodiment of the present invention. The contact terminal 100 is structured such that an opening 111 is formed in the PCB 101 and a terminal member 102 is disposed on the opening 111. An artisan should understand and appreciate that the terminal member 102 could be mounted on other types of platforms beside a PCB, although a PCB is a preferred platform.

Figure 4:
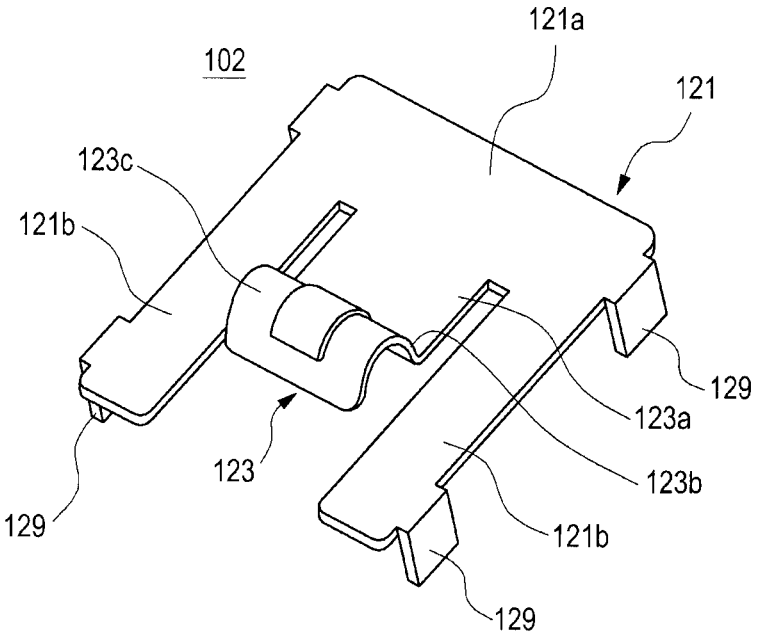
FIG. 4 is a perspective view of a terminal member of a contact terminal shown in FIG. 3.
Figure 5:
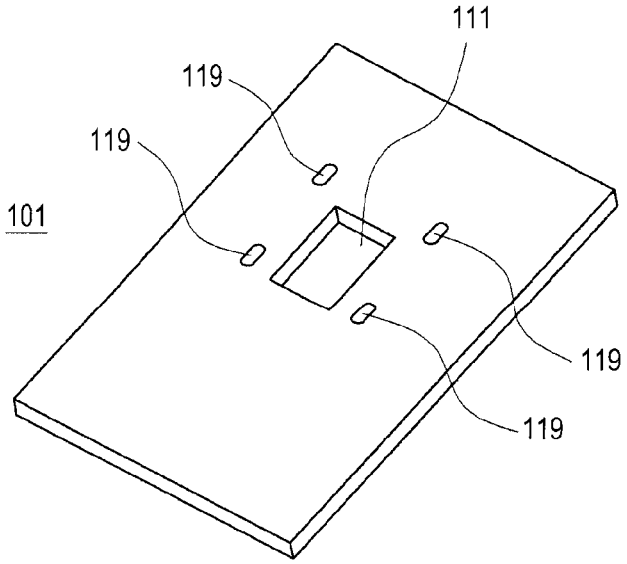
FIG. 5 is a perspective view of a PCB to which a structure of a contact terminal shown in FIG. 3 is applied.

Referring now to FIGS. 4 and 5, the terminal member 102 preferably includes a fixing portion 121 and a contact terminal portion 123 which is connected with a carrier or a battery pack of a built-in antenna. The opening 111 is formed to pass through both surfaces of the PCB 101, and the fixing portion 121 is disposed around the opening 111. The contact terminal portion 123 is disposed on the opening 111 so that at least a portion of the opening 111 in the PCB 101 is unencumbered.

Figure 1:
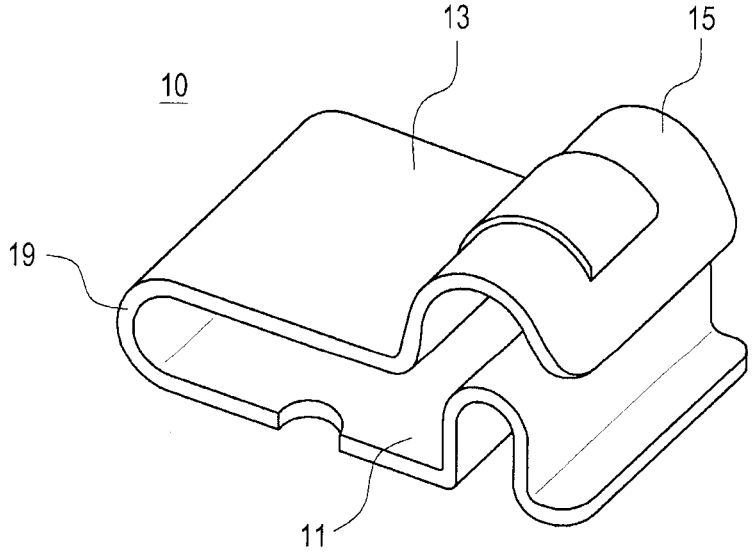
FIG.1 (PRIOR ART)
FIG. 1 is a perspective view of a terminal member of a contact terminal for a PCB according to the conventional art.
Figure 2:
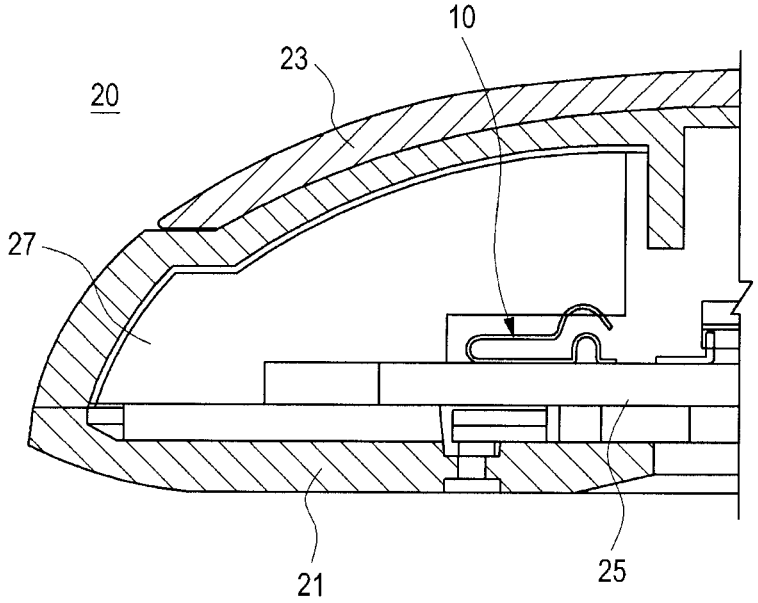
FIG.2 (PRIOR ART)
FIG. 2 is a cross-sectional view showing a state in which the terminal member shown in FIG. 2 is installed in a portable terminal according to the conventional art.

The fixing portion 121 preferably includes a first fixing portion 121*a* fixed onto a surface of the PCB 101 at an end of the opening 111 and second fixing portions 121*b* fixed onto the surface of the PCB 101 at both sides of the opening 111. The fixing portion 121 is coupled to face a surface of the PCB 101 while substantially in parallel with the PCB 101. The second fixing portions 121*b* extend substantially in parallel with each other from a side of the first fixing portion 121*a*. It can be seen that the terminal member is substantially flat and preferably a singular structure. Compared with U-shaped structures of the prior art, the substantially play terminal member provides the electrical contact function without wasting space like conventional u-shaped connection structures such as shown in FIGS. 1 and 2.

When the terminal member 102 is mounted on the PCB 101, at least a part of the contact terminal portion 123 extends inclinedly with respect to a surface of the PCB 101. Thus, the terminal member 102 includes a contact surface 123*c* in the shape of a curved surface protruding from a surface or another surface of the PCB 101. The contact surface 123*c* contacts a counterpart component of the PCB 101, e.g., a carrier or a battery pack of a built-in antenna.

The contact terminal portion 123 also extends from a side of the first fixing portion 121*a* and is positioned preferably between the second fixing portions 121*b*. The terminal member 102 is preferably made by processing a metal plate material. More specifically, a part of a metal plate in an approximately square shape is cut to form the second fixing portions 121*b* and a wing portion including the contact terminal portion 123 between the second fixing portions 121*b*. The second fixing portions 121*b* and the wing portion may be substantially in parallel with one another, that is, may be preferably manufactured in rectangular shapes which extend in parallel with one another from a side of the first fixing portion 121*a*. Afterwards, the wing portion is bent to complete the contact terminal portion 123.

In the current exemplary embodiment of the present invention, the contact terminal portion 123 includes a support portion 123*a*, an inclined portion 123*b*, and the aforementioned contact surface 123*c*. As mentioned previously, the terminal member 102 is manufactured in its preferred form by processing the metal plate, in which the first fixing portion 121*a*, the second fixing portions 121*b*, the support portion 123*a*, the inclined portion 123*b*, and the contact surface 123*c* are divided according to cut or bent structures of the metal plate, and therefore, those of ordinary skill in the art can easily understand that preferably such items are not separately manufactured and assembled.

Figure 6:
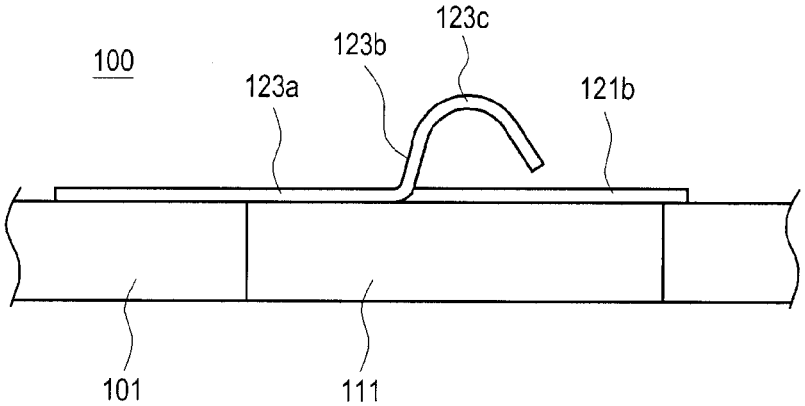
FIG. 6 is a cross-sectional view of a structure of a contact terminal shown in FIG. 3.

The support portion 123*a* extends from a side of the first fixing portion 121*a* between the second fixing portions 121*b* in parallel with the second fixing portions 121*b*, and the inclined portion 123*b* extends at an end portion of the support portion 13*a* in a direction away from a surface of the PCB 101. The contact surface 123*c* is formed by bending an end portion of the inclined portion 123*b* in a direction toward the PCB 101. Consequently, when the terminal member 102 is disposed on the surface of the PCB 101, the inclined portion 123*b* and the contact surface 123*c* protrude from the surface of the PCB 101 as shown in FIG. 6. In this view of FIG. 6, the contact terminal portion 123 is positioned on/over a portion of the opening 111, such that when the contact terminal portion 123 contacts a counterpart component, the support portion 123*a* enters the opening 111, thus accumulating an elastic force. The elastic force accumulated in the support portion 123*a* works as a force for urging the contact surface 123*c* to closely contact the counterpart component. In this way, the terminal member 102 can maintain close contact with the counterpart component.

To fix/arrange the terminal member 102 onto the PCB 101, the contact terminal 100 may include at least one or more binding pieces 129 and one or more binding holes 119 corresponding thereto. The one or more binding pieces 129 extend from an edge of the fixing portion 121 in a direction perpendicular to a surface of the fixing portion 121. In the current exemplary embodiment, the binding pieces 129 are shown as facing each other in two pairs and the number of binding pieces 129 may be adjusted variously, taking account of the size of the terminal member 102, etc.

With reference to FIG. 5, the binding holes 119 are formed around the opening 111 in positions corresponding to the binding pieces 129 to perforate the PCB 101. When the terminal member 102 is disposed on the PCB 101, the binding pieces 129 penetrate the PCB 101 through the binding holes 119, respectively. End portions of the binding pieces 129 protrude from another surface of the PCB 101, and the protruding end portions may be bent to closely contact another surface (the surface?) of the PCB 101 or may be fixed to the PCB 101 through soldering. In this way, the terminal member 102 is mounted and fixed onto the PCB 101.

A person of skill in the art should understand and appreciate that the claimed invention, while exemplified in a preferred format, is broader than shown and described herein. For example, while it is preferred that the binding pieces 129 protrude from the terminal member 102, it is within the spirit and scope of the claimed invention the binding pieces and binding holes could be reversed, although such a structure would have a more complicated and less cost-effective construction.

Figure 7:
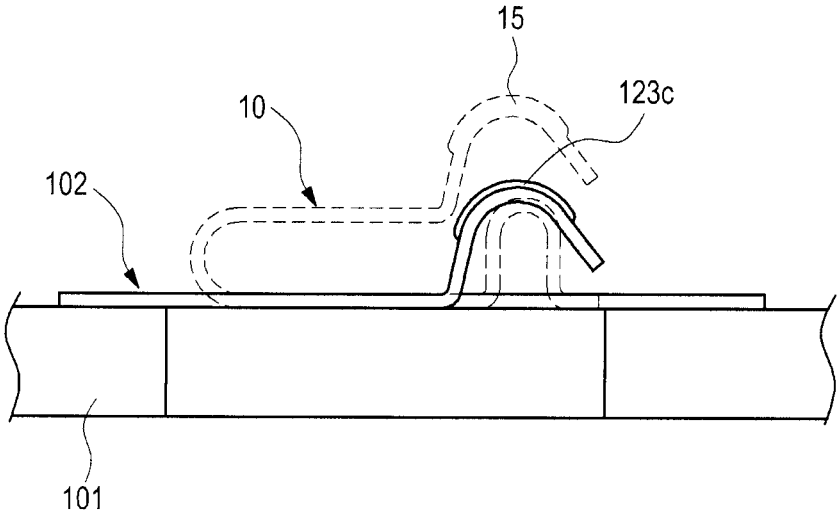
FIG. 7 is a view for comparing a structure of a contact terminal shown in FIG. 3 with a conventional contact terminal structure.

FIG. 7 is a view for comparing a structure of a contact terminal shown in FIG. 3 with a structure of a conventional contact terminal described and shown in FIGS. 1 and 2. To secure a set-back space for a contact surface when contacting a counterpart component, the conventional contact terminal is manufactured in the shape of 'U' merely by bending a metal plate; whereas a contact terminal according to the present invention has an opening in a PCB to reduce a height of a terminal member. As mentioned previously, a height from a surface of the PCB to a contact point with the counterpart component (or a contact height) is maintained to 1 mm or more in the conventional contact terminal, but in the contact terminal according to the present invention, the contact height can be reduced to approximately 0.3 mm. Prior to contact with a counterpart component, a maximum height of a contact surface from a surface of the PCB is approximately 15 mm in the conventional contact terminal, but in the contact terminal according to the present invention, the maximum height may be reduced to approximately 0.7 mm or less.

Therefore, the contact terminal according to the present invention is useful to reduce the thickness of the portable terminal and secure a mounting space of a component in the portable terminal having a given size. Moreover, since soldering may be performed when the binding pieces of the terminal member are coupled through the binding holes formed in the PCB, the terminal member can be assembled to the PCB by using Surface Mounting Technology (SMD).

Figure 8:
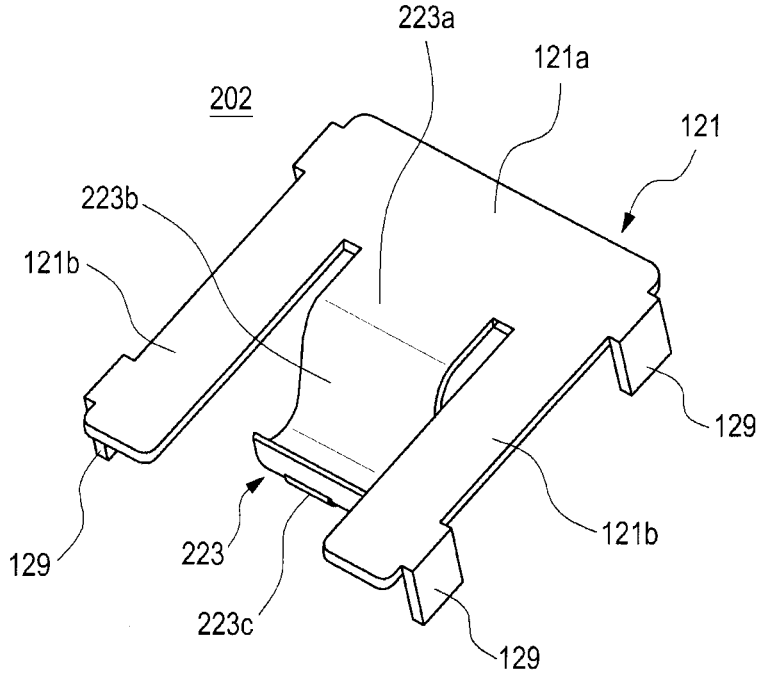
FIG. 8 is a perspective view of a terminal member of a contact terminal for a PCB according to another exemplary embodiment of the present invention.
Figure 9:
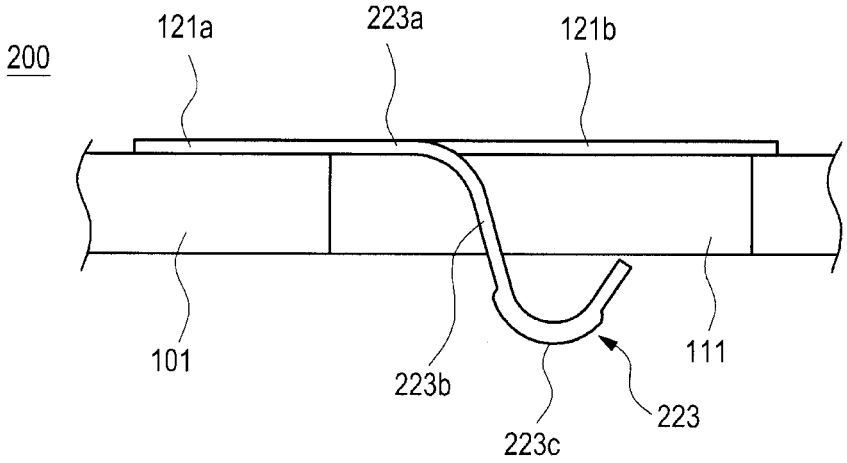
FIG. 9 is a cross-sectional view of a structure of a contact terminal in which a terminal member shown in FIG. 8 is installed.

FIGS. 8 and 9 show a terminal member 202 and a contact terminal 200 where the terminal member 202 is installed according to another exemplary embodiment of the present invention. The contact terminal 200 according to the current exemplary embodiment of the present invention is distinguished from the contact terminal 100 in that a contact terminal portion 223 of the terminal member 202 is formed by bending an inclined portion 223*b* in a different direction than the inclined portion 123*b* of the previous exemplary embodiment. Therefore, components which are substantially the same as those of the previous embodiment will be referred to by the same reference numerals or may be omitted and a description thereof may also be omitted.

The terminal member 202 of the contact terminal 200 according to the current exemplary embodiment of the present invention includes the fixing portion 121 and the contact terminal portion 223, and the contact terminal portion 223 is formed such that the inclined portion 223*b*, which is bent and extends from an end portion of a support portion 223*a*, faces another surface of the PCB 101. Thus, a contact surface 223*c* protrudes from another surface of the PCB 101 through the opening 111. In this case, a carrier connected with the PCB 101 having applied the contact terminal 200 thereto may contact the contact surface 223*c* on another surface of the PCB 101.

As mentioned above, the contact terminal may be applied to not only a built-in antenna of a portable terminal, but also a battery pack connection structure, a contact terminal used in an electronic product, a wiring terminal box, etc., just to name a few non-limiting possibilities.

As can be seen from the foregoing description, the contact terminal for the PCB can facilitate reducing a height from a surface of the PCB to a contact point with a counterpart component, i.e., a contact height. In practice, in a contact state with the counterpart component, the contact height is maintained at about 1 mm or more in the contact terminal shown in FIG. 1; whereas in the contact terminal according to the present invention, the contact height can be reduced to 0.3 mm or less. Therefore, the contact terminal for the PCB according to the present invention contributes to reducing the thickness of a portable terminal, and when being applied while maintaining the thickness of the portable terminal, the contact terminal contributes to securing a larger component-mounting space in the portable terminal.

While the invention has been shown and described with reference to exemplary embodiments thereof, it will be understood by those skilled in the art that various changes in form and details may be made therein without departing from the scope of the invention as defined by the appended claims and their equivalents.

What is claimed is:

1. An electrical connector comprising:

a fixing portion;

an opening at least partially surrounded by the fixing portion;

a contact member extending from the fixing portion over the opening, the contact member having a support portion extending substantially parallel to a surface of the fixing portion in a first direction; and a binding member extending from the fixing portion in a second direction that is different from the first direction, wherein the fixing portion, the support portion and the contact member are formed from a single metal plate that is cut or bent.

2. The electrical connector of claim 1, wherein the binding member is adapted to couple with one or more holes disposed on a printed circuit board (PCB) to mount the electrical connector onto the PCB along a periphery of the electrical connector.

3. The electrical connector of claim 1, wherein at least a portion of the contact member extends above the surface of the fixing portion and the binding member extends below the fixing portion.

4. The electrical connector of claim 1, wherein:

the electrical connector comprises a substantially planar surface to face a printed circuit board (PCB), and when the contact member is in contact with a component external to the electrical connector, at least a portion of the contact member is adapted to be positioned below the substantially planar surface.

5. An apparatus comprising:

a board member having a first opening being formed at least a portion of the board member; and an electrical connector disposed on the board member, the electrical connector including: a fixing portion at least partially surrounding a second opening, the fixing portion being disposed on the board member such that the second opening is at least in part coincident with the first opening, and a contact member extending from the fixing portion, at least a portion of the contact member comprises a support portion being adapted to be positioned in at least a portion of the first opening when in contact with a member other than the board member, wherein the fixing portion, the support portion and the contact member are formed from a single metal plate that is cut or bent.

6. The apparatus of claim 5, wherein the board member comprises one or more electronic components.

7. The apparatus of claim 5, wherein the member other than the board member includes an antenna device.

8. The apparatus of claim 7, wherein the contact member is adapted to form an electrical connection with a feeding portion of the antenna device.

9. The apparatus of claim 5, wherein the electrical connector further includes a binding portion extending from the fixing portion.

10. The apparatus of claim 9, wherein the binding portion is coupled with a third opening formed from at least a portion of the board member adjacent to the first opening.

11. The apparatus of claim 5, wherein the fixing portion includes a first fixing portion and at least one second fixing portion, such that the second opening is at least partially surrounded by the first fixing portion and the at least one second fixing portion.

12. The apparatus of claim 11, wherein the first fixing portion is positioned at one side of the contact member and the at least one second fixing portion is positioned at another side of the contact member.

13. The apparatus of claim 5, wherein the contact member is elastic, and the contact member is in a tensioned state when in contact with the member other than the board member.

14. The apparatus of claim 5, wherein the contact member comprises conductive material.

15. A conductive structure comprising:

a fixing portion of the conductive structure at least partially surrounding an opening;

a contact member extending from the fixing portion over the opening, the contact member included a support portion and an inclined portion that extends from an end of the support portion, the inclined portion being adapted to enter at least partially a space below a horizontal plane formed from a surface of the fixing portion and the opening, when the contact member contacts a component external to the conductive structure, wherein the fixing portion, the support portion and the contact member are formed from a single metal plate that is cut or bent.

16. The conductive structure of claim 15, wherein the contact member extends from the fixing portion in a first direction, the conductive structure further comprising a binding member extending from the fixing portion in a second direction that is different from the first direction.

17. The conductive structure of claim 16, wherein the binding member is adapted to mate with one or more holes disposed on a printed circuit board (PCB) to mount the conductive structure onto the PCB along a periphery of the conductive structure.

18. The conductive structure of claim 15, wherein the fixing portion comprises a first fixing portion and at least one second fixing portion, such that the opening is formed between the first fixing portion and the at least one second fixing portion.

19. The conductive structure of claim 18, wherein the first fixing portion is positioned at one side of the contact member and the at least one second fixing portion is positioned at another side of the contact member.

20. The conductive structure of claim 15, wherein the contact member is elastic, and the contact member extends over the opening when the contact member does not contact the component external to the conductive structure.

* * * * *